US006516871B1

(12) United States Patent
Brown et al.

(10) Patent No.: US 6,516,871 B1
(45) Date of Patent: Feb. 11, 2003

(54) HEAT TRANSFER ELEMENT ASSEMBLY

(75) Inventors: Gary Foster Brown, Andover, NY (US); Michael Ming-Ming Chen, Wellsville, NY (US); Wayne S. Counterman, Wellsville, NY (US); Donald J. Dugan, Wellsville, NY (US); Scott Frederick Harting, Wellsville, NY (US)

(73) Assignee: Alstom (Switzerland) Ltd., Baden (CH)

( * ) Notice: Subject to any disclaimer, the term of this patent is extended or adjusted under 35 U.S.C. 154(b) by 0 days.

(21) Appl. No.: 09/376,201

(22) Filed: Aug. 18, 1999

(51) Int. Cl.[7] ..... F23L 15/02
(52) U.S. Cl. ..... 165/8; 165/10; 165/166
(58) Field of Search ..... 165/4, 6, 8, 10, 165/166

(56) References Cited

U.S. PATENT DOCUMENTS

| | | | | | |
|---|---|---|---|---|---|
| 2,596,642 | A | * | 5/1952 | Boestad | 165/10 |
| 2,696,976 | A | * | 12/1954 | Boestad et al. | 165/10 |
| 2,879,979 | A | * | 3/1959 | Wheeler | 165/10 |
| 2,940,736 | A | * | 6/1960 | Odman | 165/8 |
| 3,183,963 | A | * | 5/1965 | Mondt | 165/10 |
| 3,373,798 | A | * | 3/1968 | Bummett | 165/10 |
| 3,463,222 | A | * | 8/1969 | Grames | 165/10 |
| 3,554,273 | A | * | 1/1971 | Kritzler | 165/10 |
| 4,744,410 | A | * | 5/1988 | Groves | 165/8 |
| 4,801,410 | A | | 1/1989 | Kinney, Jr. et al. | 261/112.2 |
| 5,836,379 | A | * | 11/1998 | Counterman | 165/8 |
| 5,944,094 | A | * | 8/1999 | Kinney, Jr. et al. | 165/166 |
| 5,979,050 | A | * | 11/1999 | Counterman et al. | 165/10 |
| 5,983,985 | A | * | 11/1999 | Counterman et al. | 165/10 |
| 6,019,160 | A | * | 2/2000 | Chen | 165/166 |

FOREIGN PATENT DOCUMENTS

| | | |
|---|---|---|
| BE | 465567 | 6/1946 |
| CH | 517280 | 12/1971 |
| DE | 1918433 | 10/1970 |
| GB | 1210228 | 10/1970 |
| WO | WO 98/57112 | 12/1998 |

OTHER PUBLICATIONS

International Search Report for International Application No. PCT/US 00/21473.

* cited by examiner

*Primary Examiner*—Christopher Atkinson
(74) *Attorney, Agent, or Firm*—Alix, Yale & Ristas, LLP

(57) ABSTRACT

The thermal performance of the heat transfer element assemblies for rotary regenerative air preheaters is enhanced to provide a desired level of heat transfer and pressure drop with a reduced weight. The heat transfer plates in the assemblies have spaced apart dimples for maintaining plate spacing and oblique undulations with the undulations on adjacent plates preferably extending at opposite oblique angles. The dimples may be on every other plate and alternate between the two sides of the plates or they may be on every plate and all extend to the same side.

12 Claims, 6 Drawing Sheets

HEAT TRANSFER ELEMENT ASSEMBLY

BACKGROUND OF THE INVENTION

The present invention relates to heat transfer element assemblies and, more specifically, to an assembly of heat absorbent plates for use in a heat exchanger wherein heat is transferred by means of the plates from a hot heat exchange fluid to a cold heat exchange fluid. More particularly, the present invention relates to a heat exchange element assembly adapted for use in a heat transfer apparatus of the rotary regenerative type wherein the heat transfer element assemblies are heated by contact with the hot gaseous heat exchange fluid and thereafter brought in contact with cool gaseous heat exchange fluid to which the heat transfer element assemblies gives up its heat.

One type of heat exchange apparatus to which the present invention has particular application is the well-known rotary regenerative heat exchanger. A typical rotary regenerative heat exchanger has a cylindrical rotor divided into compartments in which are disposed and supported spaced heat transfer plates which, as the rotor turns, are alternately exposed to a stream of heated gas and then upon rotation of the rotor to a stream of cooler air or other gaseous fluid to be heated. As the heat transfer plates are exposed to the heated gas, they absorb heat therefrom and then, when exposed to the cool air or other gaseous fluid to be heated, the heat absorbed from the heated gas by the heat transfer plates is transferred to the cooler gas. Most heat exchangers of this type have their heat transfer plates closely stacked in spaced relationship to provide a plurality of passageways between adjacent plates for the flow of the heat exchange fluids therebetween. This requires means associated with the plates to maintain the proper spacing.

The heat transfer capability of such a heat exchanger of a given size is a function of the rate of heat transfer between the heat exchange fluids and the plate structure. However for commercial devices, the utility of a device is determined not alone by the coefficient of heat transfer obtained, but also by other factors such as cost and weight of the plate structure. Ideally, the heat transfer plates will induce a highly turbulent flow through the passages therebetween in order to increase heat transfer from the heat exchange fluid to the plates while at the same time providing relatively low resistance to flow through the passages and also presenting a surface configuration which is readily cleanable.

To clean the heat transfer plates, it has been customary to provide soot blowers which deliver a blast of high pressure air or steam through the passages between the stacked heat transfer plates to dislodge any particulate deposits from the surface thereof and carry them away leaving a relatively clean surface. This also requires that the plates be properly spaced to allow the blowing medium to penetrate into the stack of plates.

One method for maintaining the plate spacing is to crimp the individual heat transfer plates at frequent intervals to provide notches which extend away from the plane of the plates to space the adjacent plates. This is often done with bi-lobed notches which have one lobe extending away from the plate in one direction and the other lobe extending away from the plate in the opposite direction. Heat transfer element assemblies of this type are disclosed in U.S. Pat. Nos. 4,396,058 and 4,744,410. In the patent, the notches extend in the direction of the general or bulk heat exchange fluid flow, i.e., axially through the rotor. In addition to the notches, the plates are corrugated to provide a series of oblique furrows or undulations extending between the notches at an acute angle to the flow of heat exchange fluid. The undulations on adjacent plates extend obliquely to the line of bulk flow either in an aligned manner or oppositely to each other. These undulations tend to produce a highly turbulent flow. Although such heat transfer element assemblies exhibit favorable heat transfer rates, the presence of the notches extending straight through in the direction of bulk flow provides significant flow channels which by-pass or short circuit fluid around the undulated, main areas of the plates. There is a higher flow rate through the notch areas and a lower flow rate in the undulated areas which tends to lower the rate of heat transfer.

SUMMARY OF THE INVENTION

An object of the present invention is to provide an improved heat transfer element assembly wherein the thermal performance is optimized to provide an improved level of heat transfer, a desired plate spacing and a reduced quantity of plate material. In accordance with the invention, the heat transfer plates of the heat transfer element assembly have oblique undulations to increase turbulence and thermal performance but they do not have the axially extending, straight through notches for plate spacing. Instead, at least every other plate contains locally raised portions or dimples of a height to properly space the plates. The dimples are formed by drawing or stretching the material locally reducing the amount of plate material compared to notched plates. The undulations on adjacent plates may extend in opposite directions with respect to each other and the direction of fluid flow.

DESCRIPTION OF THE PREFERRED EMBODIMENT

Figure 1:
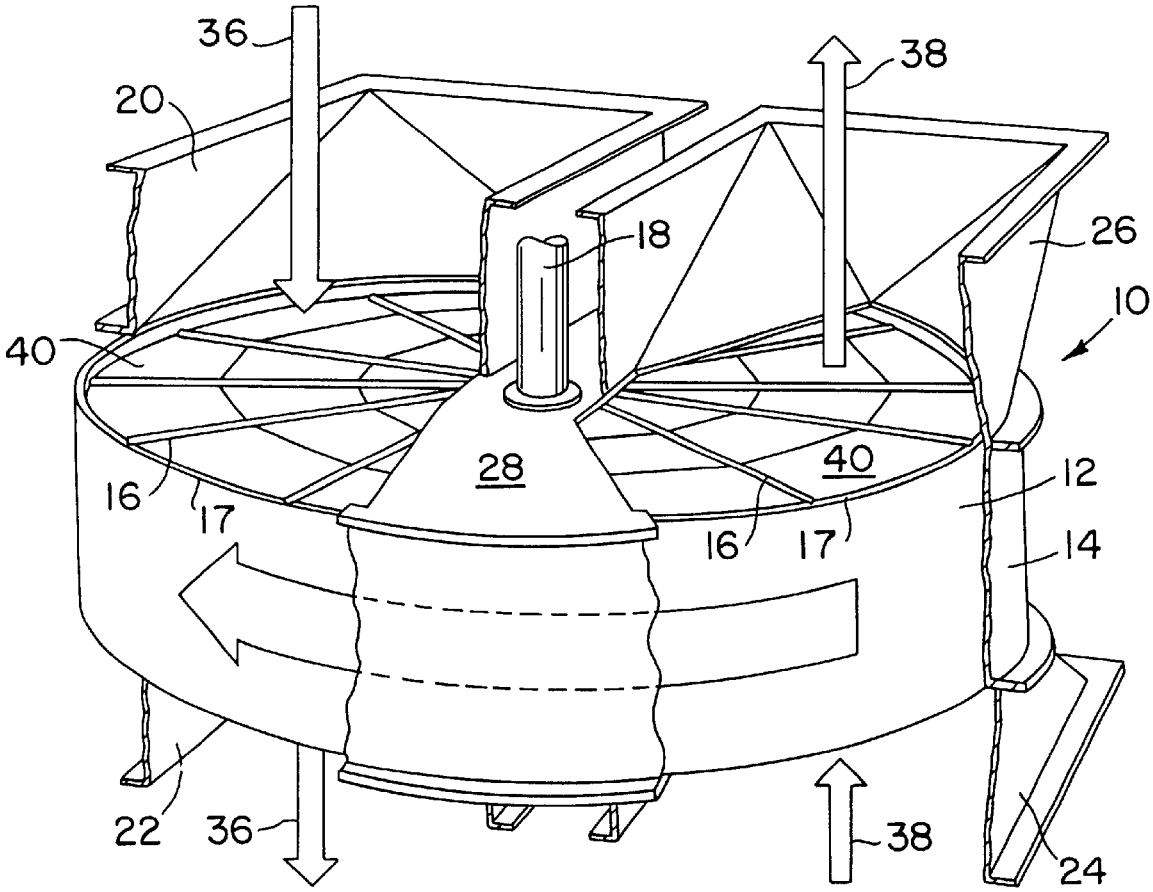
FIG. 1 PRIOR ART
FIG. 1 is a perspective view of a conventional rotary regenerative air preheater which contains heat transfer element assemblies made up of heat transfer plates.

With reference to FIG. 1 of the drawings, a conventional rotary regenerative preheater is generally designated by the numerical identifier 10. The air preheater 10 has a rotor 12 rotatably mounted in a housing 14. The rotor 12 is formed of diaphragms or partitions 16 extending radially from a rotor post 18 to the outer periphery of the rotor 12. The partitions 16 define compartments 17 therebetween for containing heat exchange element assemblies 40.

Figure 2:
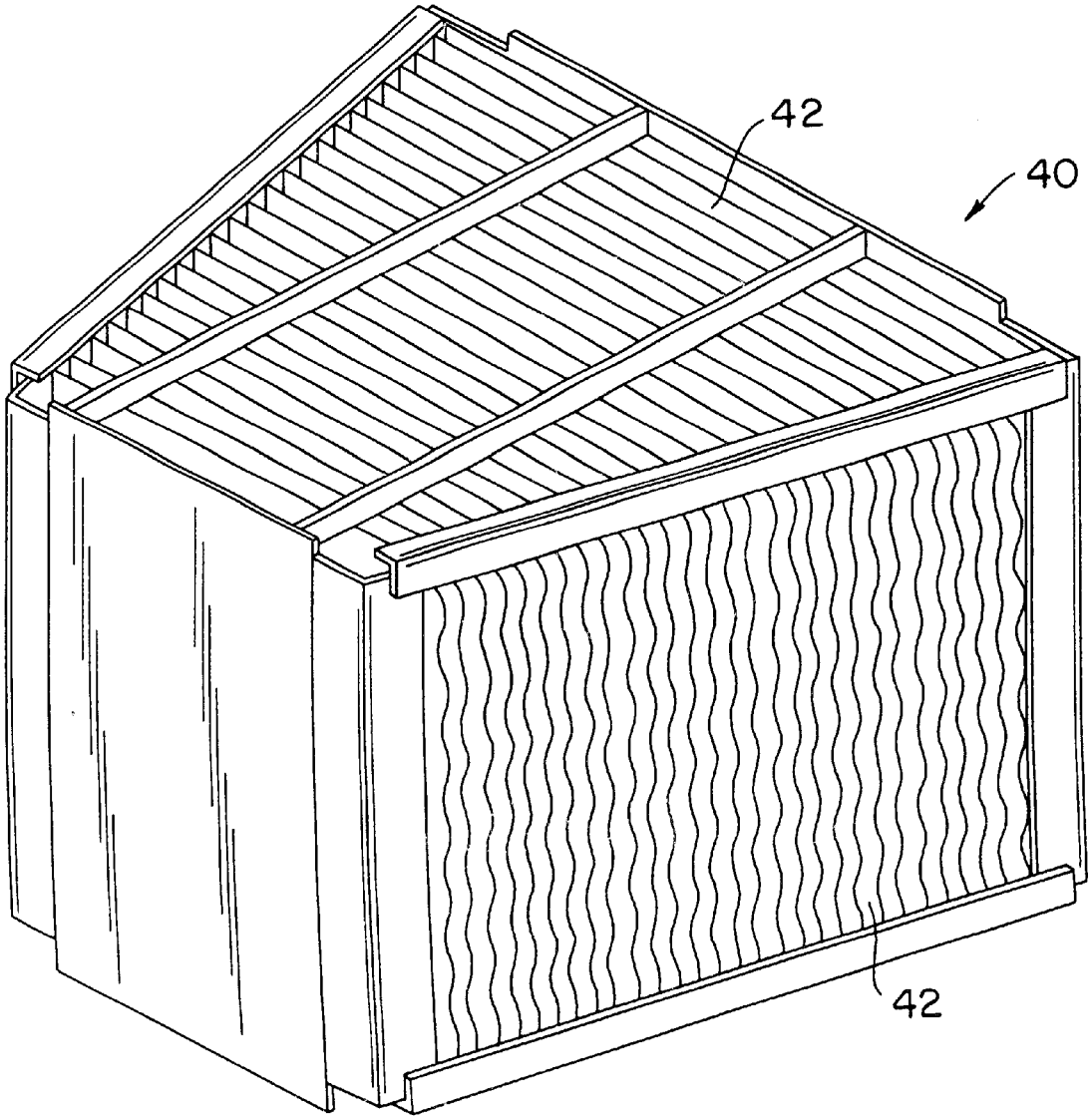
FIG. 2 PRIOR ART
FIG. 2 is a perspective view of a conventional heat transfer element assembly showing the heat transfer plates stacked in the assembly.

The housing 14 defines a flue gas inlet duct 20 and a flue gas outlet duct 22 for the flow of heated flue gases through the air preheater 10. The housing 14 further defines an air inlet duct 24 and an air outlet duct 26 for the flow of combustion air through the preheater 10. Sector plates 18 extend across the housing 14 adjacent the upper and lower faces of the rotor 12. The sector plates 28 divide the air preheater 10 into an air sector and a flue gas sector. The arrows of FIG. 1 indicate the direction of a flue gas stream 36 and an air stream 38 through the rotor 12. The hot flue gas stream 36 entering through the flue gas inlet duct 20 transfers heat to the heat transfer element assemblies 40 mounted in the compartments 17. The heated heat transfer element assemblies 40 are then rotated to the air sector of the air preheater 10. The stored heat of the heat transfer element assemblies 40 is then transferred to the combustion air stream 38 entering through the air inlet duct 24. The cold flue gas stream 36 exits the preheater 10 through the flue gas outlet duct 22, and the heated air stream 38 exits the preheater 10 through the air outlet duct 26. FIG. 2 illustrates a typical heat transfer element assembly or basket 40 showing a general representation of heat transfer plates 42 stacked in the assembly.

Figure 3:
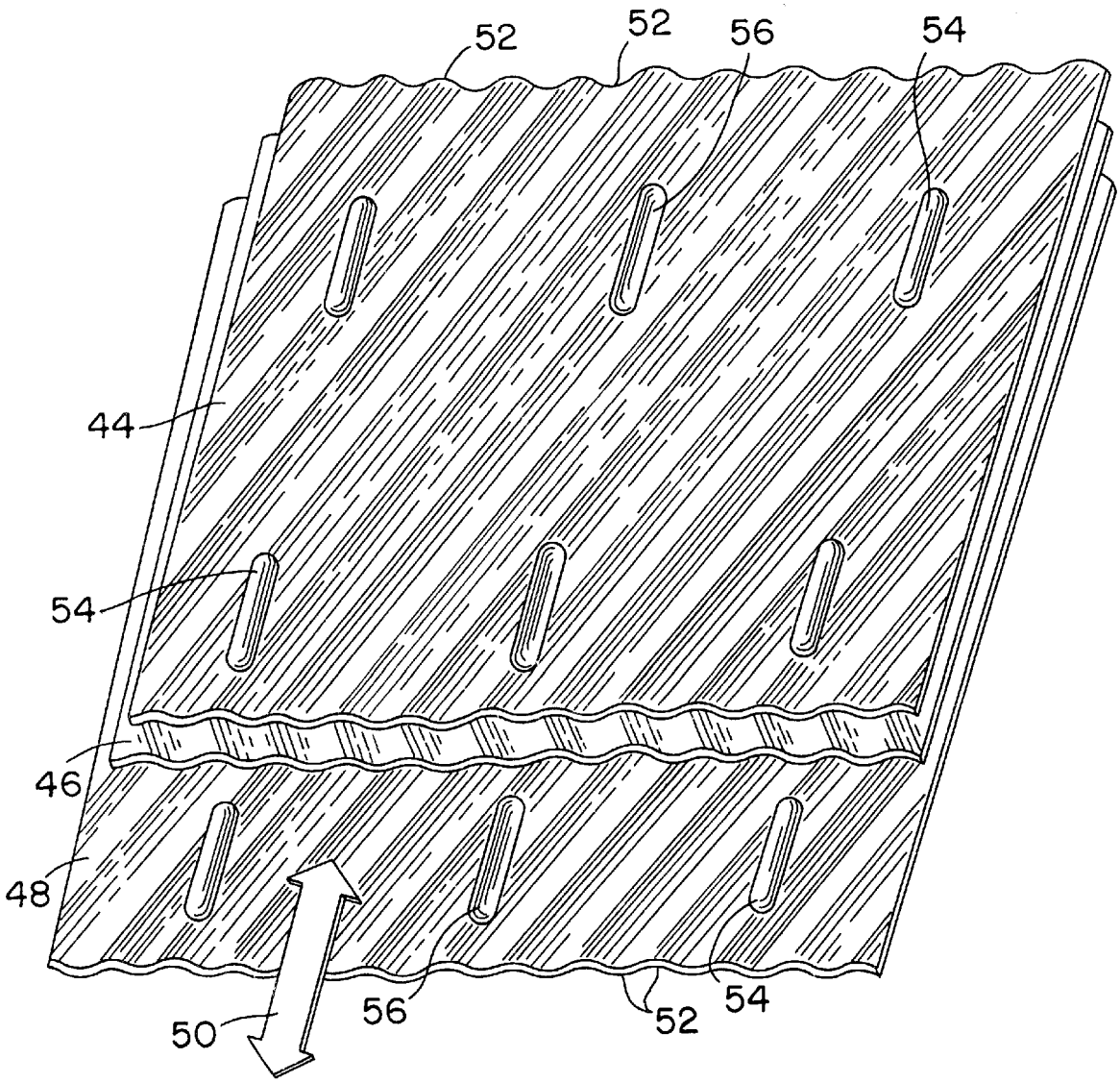
FIG. 3 is a perspective view of portions of three stacked heat transfer plates for a heat transfer element assembly in accordance with the present invention illustrating the undulations and the spacing dimples.
Figure 4:
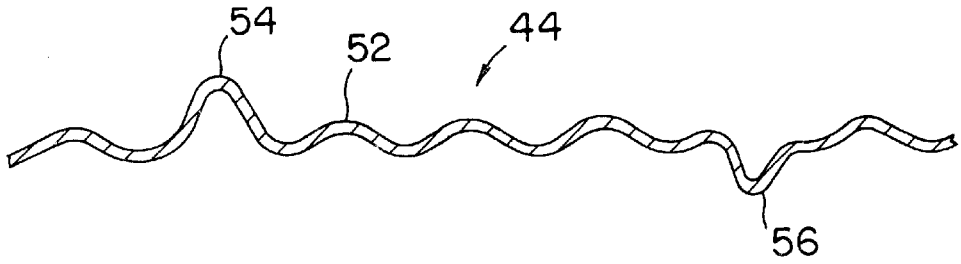
FIG. 4 is a cross section of a portion of one of the plates of FIG. 3 illustrating the undulations and dimples.

FIG. 3 depicts one embodiment of the invention showing portions of three stacked heat transfer plates 44, 46 and 48. The direction of the bulk fluid flow through the stack of plates is indicated by the arrow 50. The plates are thin sheet metal capable of being rolled or stamped to the desired configuration. The plates each have undulations or corrugations 52 which extend at an angle to the direction of fluid flow. These undulations produce turbulence and enhance the heat transfer. In the preferred embodiment as shown in this FIG. 3, the undulations on adjacent plates extend in opposite directions with respect to each other and the direction of the fluid flow. However, the undulations on adjacent plates can be in the same direction parallel to each other. Although the undulations shown in FIGS. 3 and 4 are continuous with one undulation leading directly into the next, the undulations can be spaced with flat sections in-between two undulations.

The two plates 44 and 48, which are identical to each other, have the dimples 54 and 56 formed thereon for the purpose of spacing adjacent plates. The dimples 54 extend up and the dimples 56 extend down in this FIG. 3 and as shown in FIG. 4 which is a cross section of a portion of plate 44 through two of the dimples. The height of these dimples 54 and 56 is greater than the height of the undulations 52 as seen in FIG. 4.

The dimples are narrow and elongated in the direction of fluid flow. The narrow width dimension minimizes flow blockage and undesirable pressure drop. The elongated length provides the necessary support by always resting on at least one of the undulations. Therefore, the minimum dimple length is at least equal to the pitch of the undulations and preferably longer to allow for manufacturing tolerances. However, if the dimples are too long, the flow will begin to channel without interacting with the adjacent undulations. Therefore, the dimples should not be any longer or more frequent than required for proper spacing and for structural support to withstand sootblowing and high pressure water washing. In general, the total accumulated dimple length in a row in the flow direction should be less than 50% of the plate length. Preferably, this total dimple length should be 20 to 30% of the plate length. Just as one example, the dimple length may be 1.25 inches with 3.5 inch spacings between dimples.

Figure 6:
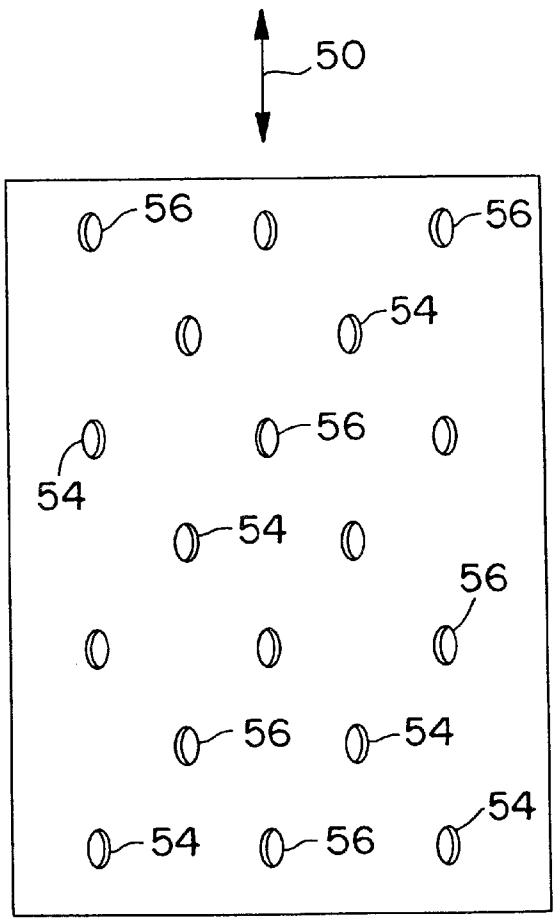
FIGS. 5 and 6 are illustrations of two of the various configurations of dimples.
Figure 5:
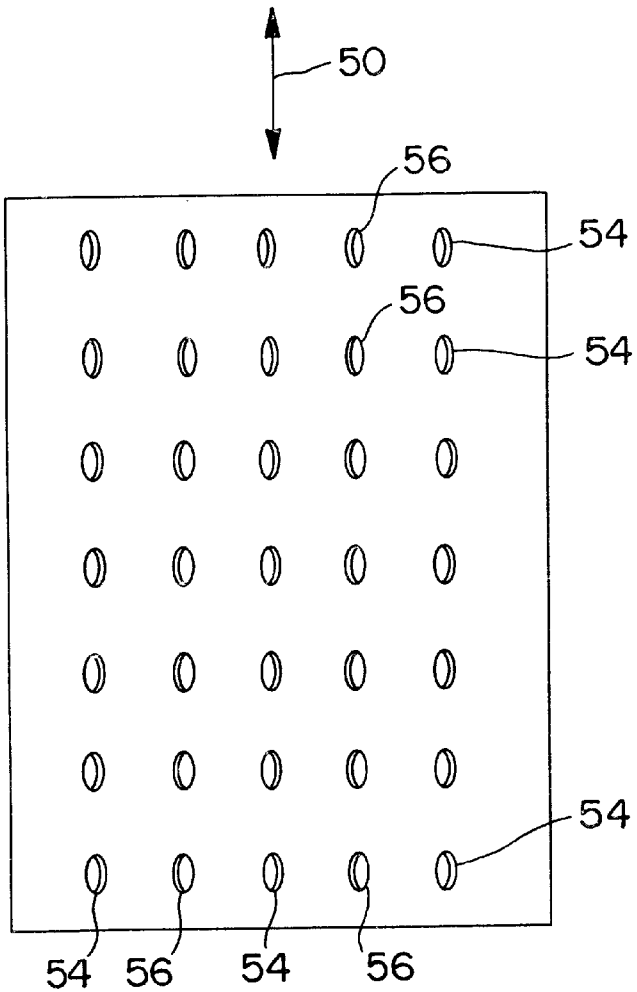

The pattern of dimples can vary as desired. For example, the pattern may be in-line alternating rows of up and down dimples alternating between adjacent rows in the longitudinal direction of flow 50 as illustrated in FIG. 5 alternating between adjacent transverse rows, or adjacent diagonal rows. In another example, the dimples can be arranged in a diamond pattern as shown in FIG. 6. Once again, the alternating rows can be longitudinal, transverse or diagonal.

Figure 7:
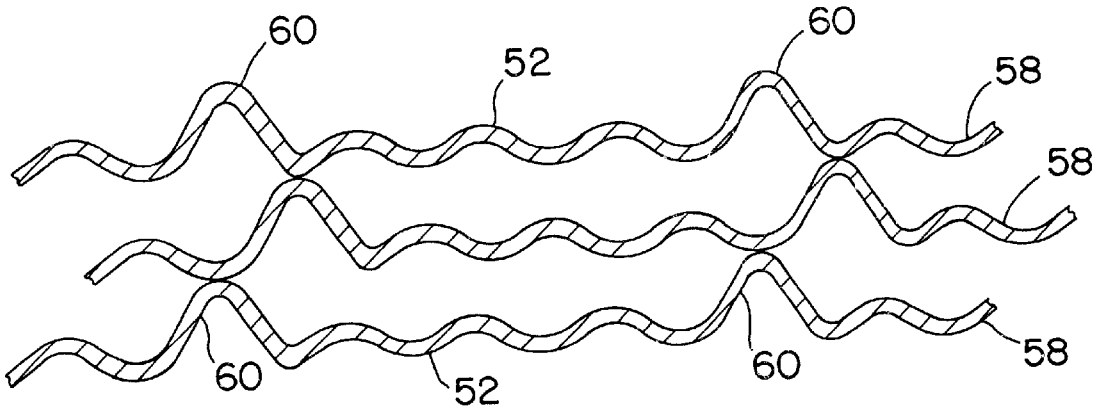
FIG. 7 is a cross section of portions of three plates of a stack showing a variation of the invention.

As indicated, the FIG. 3 embodiment of the invention only has dimples on every other plate which is all that is needed for spacing purposes with the up-down pattern of dimples. However, dimples could be located on every plate and the dimples on each plate could be on one side of the plates. FIG. 7 shows a cross section of portions of three stacked plates 58 which have the undulations 52 but which each have dimples 60 all extending to the same side of the plate.

The dimples are formed by a press forming or roll forming process which locally draws and deforms the metal. The preferred method is roll forming due to the inherent faster production speed. This is contrasted to the formation of the notches in the prior art which is a bending process with no significant drawing or deformation which consumes material and requires a wider metal sheet. The drawing process, which deforms and stretches the metal, does not consume material. The approximate savings of material is about 8%.

Figure 8:
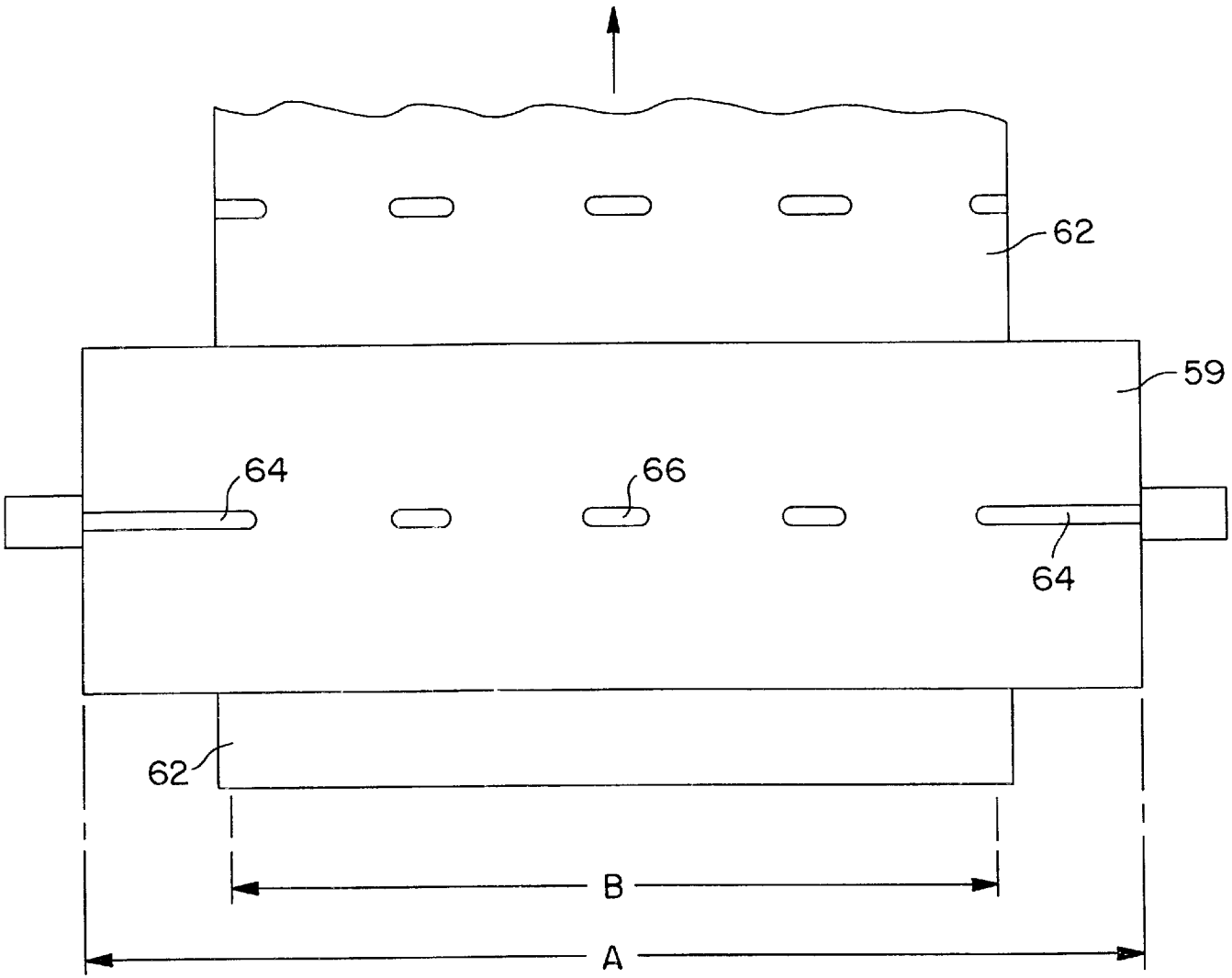
FIG. 8 illustrates a roll forming method for producing the dimples with a roll to accommodate varying plate lengths.

In the present invention, it is preferred that the dimples at one end or perhaps both ends of the plate be at or relatively close to the ends for the purpose of stiffening and supporting the ends of the plates. This is particularly desirable on the ends of the plates subjected to frequent and/or higher pressure sootblowing or water washing. The dimples at these ends prevent or reduce the plate deflection and fatigue and improve plate life. One choice is to have the dimples proximate to and spaced only slightly from the ends, perhaps about ¾ inches or less. The other choice is to have the dimples actually extending to the ends. One way to form plates with the dimples extending to the ends and to accommodate the formation of plates of varying lengths is illustrated in FIG. 8. This is a plan view of a forming roll 60 containing a dimple pattern and a portion of a plate 62 being formed. A complementary forming roll would be located below roll 60 and the plate passes between the two forming rolls. The forming rolls are long enough to accommodate plates of the maximum expected length and have a dimple pattern to also accommodate shorter plates. At the ends (or at least one end) of the roll 60 are dimple forming patterns 64 which have an extended length greater than the length of a desired normal dimple. The dimple forming patterns 66 between the ends are of the normal length. As an example, the dimple forming patterns 64 may be about 4 inches in length while the normal dimple forming patterns may be about the 1.25 inches previously mentioned. This roll 60 can thereby accommodate a plate as long as "A" or as short as about "B" and still have dimples formed at both ends of the plates.

The present invention provides a savings of material and enhanced heat transfer. Also, the plate arrangement is open to allow easy cleaning by sootblowing or water washing to remove fouling deposits and to provide for the escape of infrared radiation for the detection of over-temperature conditions.

What is claimed is:

1. A heat transfer assembly for a heat exchanger comprising a plurality of first heat absorbent plates and a plurality of second heat absorbent plates stacked alternately in spaced relationship thereby providing a plurality of passageways between adjacent first and second plates for flowing a heat exchange fluid therebetween in a longitudinal direction, each of said first and second plates having a plurality of undulations extending at an angle to said longitudinal direction, and each of said first plates having a selected length in said longitudinal direction and further having a plurality of spaced apart longitudinally extending parallel rows each containing a plurality of spaced apart longitudinally extending dimples wherein a portion of said dimples project outwardly from one side of said first plates and another portion project outwardly from the other side of said first plates and wherein the total accumulated length of dimples in each row is less than 50% of said selected length of said plate, said dimples forming spacers between adjacent plates.

2. A heat transfer assembly as recited in claim 1 wherein said undulations on adjacent plates extend at opposite angles with respect to said longitudinal direction.

3. A heat transfer assembly as recited in claim 1 wherein said first plates have longitudinal ends and have dimples extending to at least one of said longitudinal ends.

4. A heat transfer assembly as recited in claim 1 wherein said first plates have longitudinal ends and wherein dimples are proximate to at least one of said longitudinal ends spaced a distance such that said proximate dimples provide flexural support for said longitudinal ends.

5. A heat transfer assembly as recited in claim 1 wherein said total accumulated length is from 20% to 30% of said selected length.

6. A heat transfer assembly for a heat exchanger comprising a plurality of heat absorbent plates stacked in spaced relationship thereby providing passageways between adjacent plates for flowing a heat exchange fluid therebetween in a longitudinal direction, each plate having a plurality of undulations extending at an angle to said longitudinal direction and having a selected length in said longitudinal direction and at least alternate ones of said stacked plates containing a plurality of spaced apart longitudinally extending parallel rows each containing a plurality of spaced apart longitudinally extending dimples projecting outwardly from said plates forming spacers between adjacent plates wherein the total accumulated length of dimples in each row is less than 50% of said selected length.

7. A heat transfer assembly as recited in claim 6 wherein said undulations on adjacent plates extend at opposite angles with respect to said longitudinal direction.

8. A heat transfer assembly as recited in claim 6 wherein each one of said plates contains said dimples and wherein said dimples on each one of said plates project outwardly from one side of said plates.

9. A heat transfer assembly as recited in claim 8 wherein said undulations on adjacent plates extend at opposite angles with respect to said longitudinal direction.

10. A heat transfer assembly as recited in claim 6 wherein said first plates have longitudinal ends and have dimples extending to at least one of said longitudinal ends.

11. A heat transfer assembly as recited in claim 6 wherein said plates have longitudinal ends and wherein dimples are proximate to at least one of said longitudinal ends spaced a distance such that said proximate dimples provide flexural support for said longitudinal ends.

12. A heat transfer assembly as recited in claim 6 wherein said total accumulated length is from 20% to 30% of said selected length.

* * * * *